United States Patent [19]

Namekata

[11] 4,407,640

[45] Oct. 4, 1983

[54] RECIPROCATING PUMP HAVING UNIQUE PRESSURE CONTROL VALVE CONSTRUCTION

[75] Inventor: Yoriaki Namekata, Osaka, Japan

[73] Assignee: Arimitsu Industry Co., Ltd., Osaka, Japan

[21] Appl. No.: 261,205

[22] PCT Filed: Jan. 25, 1980

[86] PCT No.: PCT/JP80/00009

§ 371 Date: May 18, 1981

§ 102(e) Date: May 7, 1981

[87] PCT Pub. No.: WO81/00889

PCT Pub. Date: Apr. 2, 1981

[30] Foreign Application Priority Data

Sep. 18, 1979 [JP] Japan ..... 54-120480

[51] Int. Cl.[3] ..... F24B 49/08

[52] U.S. Cl. ..... 417/296; 417/311

[58] Field of Search ..... 417/285, 286, 296, 307, 417/311

[56] References Cited

U.S. PATENT DOCUMENTS

| | | | |
|---|---|---|---|
| 862,867 | 8/1907 | Eggleston | 417/390 |
| 2,726,032 | 12/1955 | Cooper et al. | 417/296 |
| 3,255,954 | 6/1966 | Norlin et al. | 417/311 |

FOREIGN PATENT DOCUMENTS

| | | | |
|---|---|---|---|
| 559474 | 6/1923 | France | 417/307 |
| 324404 | 12/1933 | Italy | 417/311 |
| 223603 | 6/1925 | United Kingdom | 417/307 |

*Primary Examiner*—Richard E. Gluck

*Attorney, Agent, or Firm*—Stevens, Davis, Miller & Mosher

[57] ABSTRACT

A reciprocating pump, in which a pressure control valve has a pressure-receiving face and is supported to a valve seat bearing at least one of suction and discharge valves, the pressure-receiving face being disposed within a discharge passage, and at a cylinder head is provided a pressure adjuster for a control spring biasing the pressure control valve to the valve seat, so that the pressure control valve, which functions as a relief valve, safety valve or unloader valve, may be incorporated with a main body of the pump so as to simplify construction and decrease the number of parts, thereby making the pump less expensive to produce, smaller in size, and lighter in weight.

2 Claims, 3 Drawing Figures

RECIPROCATING PUMP HAVING UNIQUE PRESSURE CONTROL VALVE CONSTRUCTION

FIELD OF THE ART

This invention relates to a reciprocating pump, and, more particularly, it relates to a reciprocating pump which has provided, at the foremost or front end of a cylinder supporting a freely reciprocable plunger, a suction passage, a discharge passage, a valve gear comprising a suction valve and a discharge valve, and a pressure control valve, all located so that the plunger reciprocates to actuate the suction valve and discharge valve to thereby discharge pressure fluid while the pressure control valve adjusts pressure within the discharge passate to a desired value.

BACKGROUND OF THE ART

Conventionally, a reciprocating pump which is provided with a pressure control valve device so as to adjust fluid pressure within a discharge passage in a desired value is well-known.

The conventional pressure control valve device is so constructed that a valve seat and a valve body are assembled into a valve box formed separately from the main body of the reciprocating pump. A spring housing cylinder is provided within the valve box, and this cylinder supports a control spring biasing the valve body to the valve seat as well as an adjuster for adjusting the biasing force of the control spring. The pressure control valve device is disposed at a halfway position within the discharge passage of the pump so that the valve box communicates at the inlet side thereof with the discharge passage, while the outlet side of the valve box communicates with a hose open to the atmosphere.

The pressure control valve device, to date, which is separate from the main body of the pump, is complex in construction and increases the number of necessary parts. This results in a pump which is complicated to assemble, expensive as a whole to manufacture, and larger in size and weight.

Another well-known pressure control valve device employs an unloader valve instead of a relief valve. When the unloader valve is used, the pressure control valve device becomes more complex in construction which leads to a higher manufacturing cost.

This invention has been designed to overcome these problems. A main object of the invention is to provide a reciprocating pump capable of adjusting pressure within the discharge passage in a set value, thereby reducing the number of parts and facilitating its assembly.

Another object of the invention is to provide a reciprocating pump simple in construction and capable of immediately unloading the liquid discharged from the discharge passage when the pressure within the discharge passage reaches the set value.

DISCLOSURE OF THE INVENTION

The present invention is characterized in that a pressure control valve is supported to a valve seat bearing at least one of a suction valve and discharge valve actuated by reciprocation of a plunger, the control valve is disposed at a discharge passage formed at a cylinder and biased to the valve seat by means of a control spring, and a pressure adjuster supporting the control spring is mounted on the cylinder so as to be movable. The pressure control valve is adapted to be assembled by use of the cylinder, thereby eliminating the aforesaid conventional problems in the assembly of a valve box separate from the main body of the pump.

Furthermore, the foregoing reciprocating pump is provided at the outer periphery of the pressure control valve with a pressure-receiving portion having a pressure-receiving area larger than that of a pressure-receiving face of the control valve within the discharge passage, while a pressure chamber is provided between the pressure-receiving portion and the cylinder, a check valve is interposed in the path of a liquid delivery conduit communicating with an outlet of the discharge passage, and a by-pass conduit is provided at the liquid delivery conduit at the outlet side of the check valve so that the by-pass conduit communicates with the pressure chamber. Hence, the pressure control valve is formed as an unloader valve of simple construction.

THE BEST FORM FOR PRACTICE OF THE INVENTION

The best form for practice of the invention will be detailed in accordance with the drawings.

Figure 1:
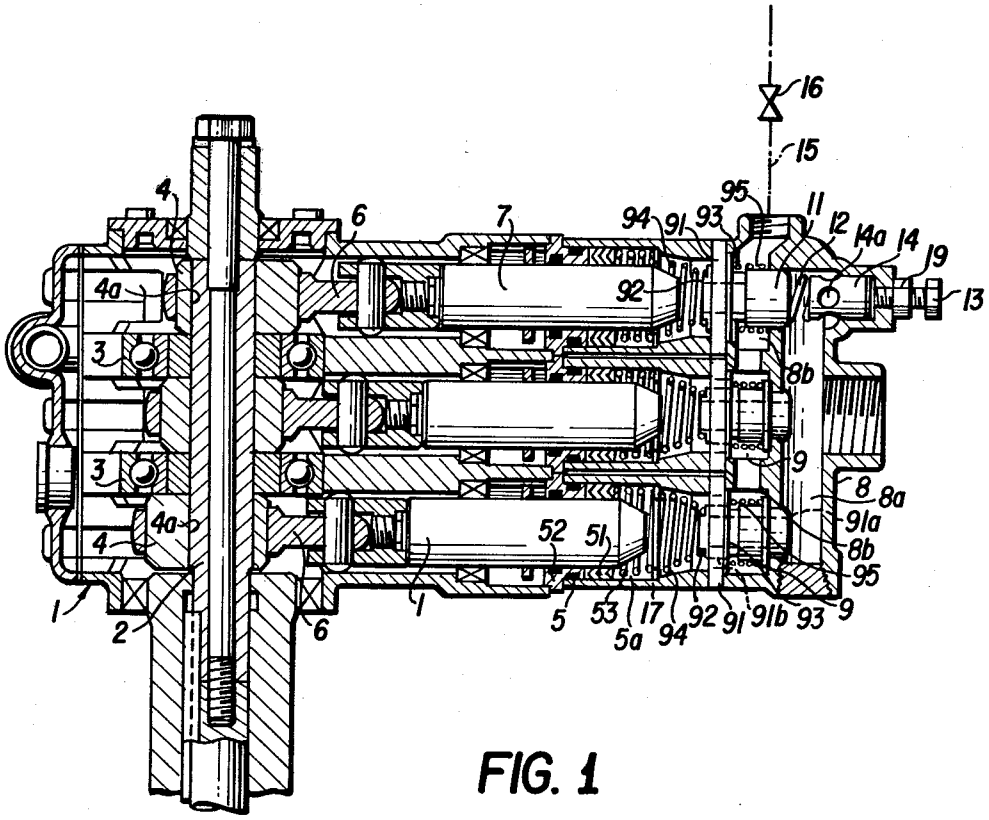
FIG. 1 is a schematic longitudinal sectional view of an embodiment of the invention.
Figure 2:
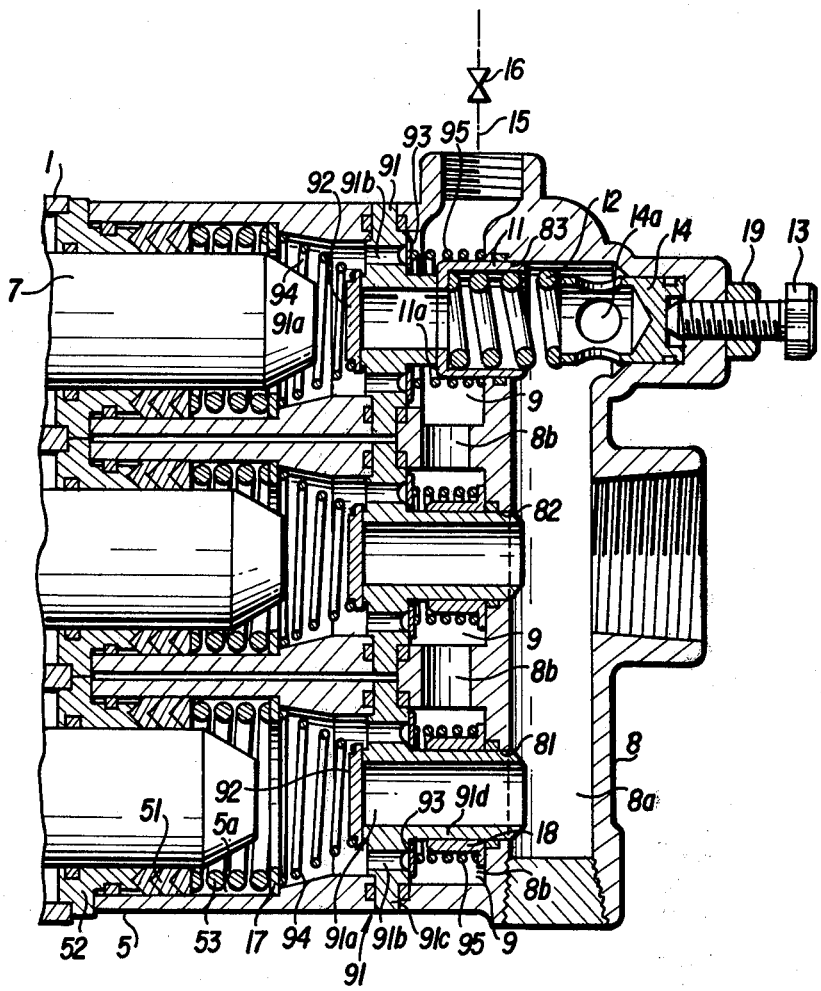
FIG. 2 is an enlarged sectional view of a principal portion thereof.

Referring to FIGS. 1 and 2, a triplex reciprocating pump has three plungers disposed in parallel. The pump is basically constructed such that a drive shaft 2 is supported rotatably to a housing 1 through bearings 3, three cylindrical cam bodies 4 each having an eccentric shaft bore 4*a* are mounted on the drive shaft 2, three cylinders 5 are mounted on the housing 1, three plungers 7 connected to the cam bodies 4 through rods 6 are housed within the cylinder chambers 5*a* so as to be freely reciprocating, a cylinder head 8 having a suction passage 8*a* and discharge passage 8*b* and three valve devices 9, are provided at the foremost (rightmost or front end in FIG. 1) ends of cylinders 5 respectively, and a pressure control valve 11 is incorporated with one cylinder 5.

Between the outer periphery of each plunger 7 and the inner periphery of each cylinder chamber 5*a* are provided a sealing member 51, a seal holder 52 supporting the sealing member 51, and a spring 53 biasing the sealing member 51 to the seal holder 52. Each cylinder 5 is sandwiched between the cylinder head 8 and the housing 1 and fixed thereto by mounting bolts (not shown).

Each of the valve devices 9 comprises a valve seat 91 having at its center a suction bore 91*a* and at the outer peripheral portion a discharge bore 91*b*, a suction valve 92 to open and close the suction bore 91*a*, a discharge valve 93 to open and close the discharge bore 91*b*, and a first and a second valve spring 94 and 95 for biasing the suction valve 92 and discharge valve 93 to the valve seat 91. The valve seat 91 comprises a valve seat body 91*c* of a round plate-like shape and a cylindrical portion 91*d* extending axially outwardly from the central portion at one side of body 91*c*, so that the suction bore 91*a* is formed of a through bore at the center body 91*c* and of a space within the cylindrical portion 91*d*. The discharge bore 91*b* is formed at the outer peripheral portion of body 91*c*. The body 91*c* is interposed at the outer-peripheral edge thereof between the foremost end face of each cylinder 5 and the cylinder head 8, and fixed together with each cylinder 5 to the housing 1 through the fixing of cylinder head 8. In addition, the body 91*c* and cylindrical portion 91*d* may be integral or separate. When separated, there is advantage in that the body 91*c* and cylindrical portion 91*d* are easy to manufacture.

The suction valve 92 is disposed at the outlet side of suction bore 91*a*, i.e., within the cylinder chamber 5*a*, and the discharge valve 93 is disposed at the outlet side of discharge bore 91*b*, i.e., within the discharge passage 8*b*, so that the first and second valve springs 94 and 95 bias the suction valve 92 and discharge valve 93 to the valve seat 91. Between the suction passage 8*a* of cylinder head 8 and the discharge passage 8*b* thereof are provided three through bores 81, 82 and 83. The cylindrical portions 91*d* at two of the valve seats 91 are inserted at one end into the two through bores 81 and 82 so that the suction bores 91*a* at the two valve seats 91 are allowed to communicate with the suction passage 8*a*.

A separate remaining valve seat 91 has its cylindrical portion 91*d* smaller in axial length than the other two valve seats, and the pressure control valve 11 is supported to said cylindrical portion 91*d* at one axial end thereof, i.e., at the inlet side of suction bore 91*a*. The control valve 11 comprises a cylindrical body which has a larger outer diameter than the cylindrical portion 91*d* at the valve seat 91 and is provided at one axial end with a ring-like shaped bottom plate which has an inner diameter which is substantially equal to the cylindrical portion 91*d* so that the bottom plate forms a pressure-receiving face 11*a*.

The control valve 11 constructed as described above has the bottom plate disposed within the discharge passage 8*b* and abutting against the cylindrical portion 91*d*, and is inserted at the open end into the bore 83 at the cylinder head 8 so as to be axially movable, whereby the suction bore 91*a* formed at the remaining cylindrical portion 91*d* communicates with the suction passage 8*a* through the control valve 11.

A control spring 12 acts on the control valve 11 to thereby bias the pressure-receiving face 11*a* of the bottom plate to the foremost end face of cylindrical portion 91*d*. A pressure adjuster 13 is screwed with the cylinder head 8 and provided with a spring holder 14 having liquid-circulation bore 14*a*, so that the spring holder 14 supports one end of the spring 12 which is seated at the other end on the inside of the bottom plate of control valve 11.

Hence, the adjuster 13 is operated to elastically transform the control spring 12 to thereby adjust the biasing force of control valve 11 applied to the valve seat 91. The adjustment of biasing force can adjust liquid pressure when the control valve 11 opens, and set liquid pressure within the discharge passage 8*b* to a desired value.

In the embodiment described above, the drive shaft 2 rotates to reciprocate the plunger 7. When the plunger 7 moves backward, the discharge valve 93 closes and the suction valve 92 opens, whereby liquid stored within a tank or the like is taken into the suction passage 8*a* through an inlet thereof and then into the cylinder chamber 5*a* through the suction passage 8*a* and suction bore 91*a*. When the plunger 7 moves forward, the suction valve 92 closes and the discharge valve 93 opens, whereby the liquid taken into the cylinder chamber 5*a* is pressurized and then discharged into the discharge passage 8*b*. The liquid discharged into the discharge passage 8*b* is controlled under pressure set by biasing the control valve 11 to the valve seat 91, thereby being discharged into a liquid delivery conduit 15 through the outlet of discharge passage 8*b*. For example, when a gate valve located in the vicinity of an outlet of the liquid delivery conduit 15 closes or a load connected thereto increases to thereby raise the liquid pressure within the discharge passage 8*b* more than the set value, a pushing-up force applied to the pressure-receiving face 11*a* at the control valve 11 exceeds the biasing force applied to the valve seat 91 by the control valve 11, whereby the pushing-up force opens the control valve 11 to allow the pressurized liquid within the discharge passage 8*b* to flow into the suction passage 8*a* through the control valve 11, thus keeping the liquid pressure within the discharge passage 8*b* at the set value.

The aforesaid embodiment is further provided with valve seat 91, which has suction bore 91*a* and discharge bore 91*b* and, bears the suction valve 92 and discharge valve 93, and supports the pressure control valve 11. Alternatively, the control valve 11 may be supported to a valve seat which is adapted to have the suction bore and support the suction valve 92 only, or the control valve may be supported to a valve seat having the discharge bore and bearing the discharge valve 93 only.

In FIG. 1, reference numeral 17 designates a holder for the spring 53 biasing the sealing member 51, 18 designates a guide tube for the second valve spring 95 biasing the discharge valve 93, and 19 designates a lock nut.

Figure 3:
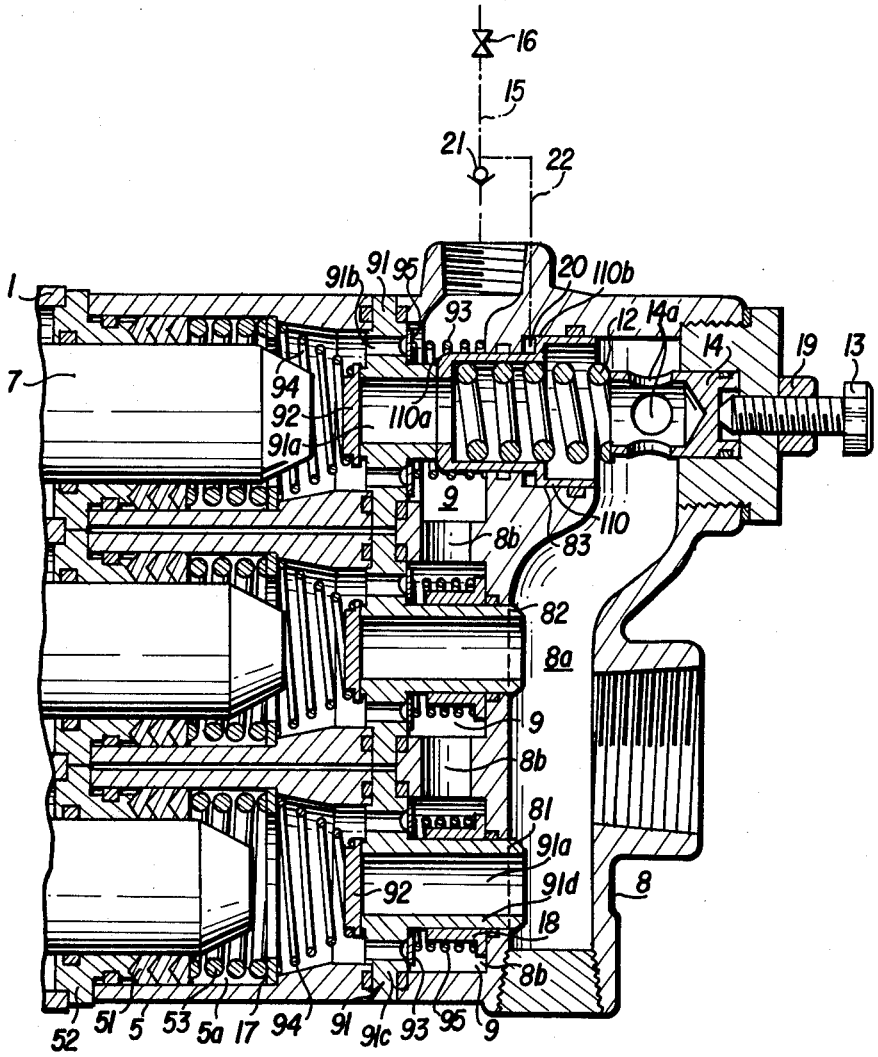
FIG. 3 is an enlarged sectional view of a modified embodiment of the invention, corresponding to FIG. 2.

In the aforesaid embodiment, the pressure control valve 11, which functions as a relief valve or safety valve, can, alternatively, be constructed to function as an unloader valve as shown in FIG. 3.

A modified embodiment of the invention shown in FIG. 3 is basically the same as the former embodiment in FIG. 1, in which each member identical in construction with that in FIG. 1 is represented by the same reference numeral.

The construction shown in FIG. 3 is different from that of FIG. 1 in that: a pressure control valve 110 is formed of a stepped cylindrical member and has at one axial end of a smaller diameter portion a ring-like shaped bottom plate to thereby form a first pressure-receiving face 110*a*, and at the intermediate shoulder a second pressure-receiving face 110*b* larger in a pressure-receiving area than the first pressure-receiving face 110*a*; a pressure chamber 20 is provided at the suction passage 8*a* side of through bore 83 formed at the cylinder head 8; a check valve 21 is interposed on the way of the liquid delivery conduit 15 communicating with the outlet of discharge passage 8*b*; and a by-pass conduit 22 is connected to the liquid delivery conduit 15 at the outlet side of check valve 21 and communicates with the pressure chamber 20. In addition, the embodiment in FIG. 3 may not have the pressure adjuster 13.

When the plunger 7 reciprocates to discharge liquid to which pressure has been applied within the cylinder chamber 5*a*, the liquid is discharged into the discharge passage 8*b* from which it is delivered and toward the liquid delivery conduit 15. If a gate valve 16 located in the vicinity of the outlet of liquid delivery conduit 15 is closed, or a load connected thereto increases, thereby making pressure within the discharge passage 8*b* and liquid delivery conduit 15 equal to the set value, the pressure of pressure chamber 20 also reaches the set value. Hence, the first and second pressure receiving faces 110*a* and 110*b* at the pressure control valve 110 are subjected to the pushing-up force larger than that normally applied to the first and second faces 110*a* and 110*b*, whereby the larger pushing-up force instantaneously opens the control valve 110 to allow the pressurized liquid to flow out of the discharge passage 8*b* into the suction passage 8*a*.

This flow-out of liquid lowers pressure within the discharge passage 8*b*, but pressure within the pressure chamber 20 is kept at the set value or higher unless the gate valve 16 is opened or the load is reduced. Consequently, the control valve 110 is kept open to enable the plunger 7 to work with no load.

When the gate valve 16 opens or the load decreases so that the pressure within the liquid delivery conduit 15 at the outlet side of check valve 21 is lowered to the set value or less, the pressure in the pressure chamber 20 is also lowered and the control spring 12 biases the control valve 110 closed so that the liquid discharged from the cylinder chamber 5*a* into the discharge passage 8*b* is delivered toward the liquid delivery conduit 15 under pressure of at or lower than the set value.

The aforesaid embodiment shows a triplex reciprocating pump. Alternatively, this invention may be applied to a single, double, or four or more cylinder type pump.

As clearly understood from the aforesaid description, the reciprocating pump of the invention is so constructed that the pressure control valve is supported to the valve seat bearing the suction valve or discharge valve and disposed at the discharge passage, and the pressure adjuster is provided at the cylinder. This allows adjustment of liquid pressure, in a device which is simpler in construction and which has fewer parts in comparison with a conventional pump. In other words, there is no need for using a valve seat for the pressure control valve only, a valve box supporting the valve seat, and a cylinder housing therein a control spring and supporting the pressure adjuster. Furthermore, pressure control can be executed by returning the discharged liquid toward the suction passage to thereby eliminate the requirement of a hose, the result being that the pump becomes simpler in construction with fewer parts.

Therefore, the improved pump is easy to assemble, considerably less expensive to manufacture, is smaller in size and is lightweight. Furthermore, the aforesaid construction can be utilized to form a pressure chamber and in effect perform the functions of an unloader valve, thus simplifying the construction while reducing the number of parts. As a result, the pump also is easy to assemble, considerably less expensive to produce, compact in size and light in weight.

POSSIBILITY OF UTILIZATION FOR INDUSTRY

As seen from the above, the reciprocating pump of the invention is useful as a hydraulic pump for machine tools, a pump for sprinkling a liquid over crops, a high pressure water pump for flushing a hull or the like, a fire pump loaded on a motor fire engine, and is especially suitable for a pump having a gate valve incorporated with the liquid delivery conduit.

I claim:

1. A reciprocating pump, comprising:

a cylinder;

a freely reciprocable plunger supported within said cylinder; and a suction passage, a discharge passage and a valve device located at a front end of said cylinder, said valve device comprising:

a valve seat having a suction bore in its central portion and a discharge bore in its outer peripheral portion;

a pressure control valve, supported by the valve seat, having at least one pressure receiving surface disposed within said discharge passage, said pressure control valve being biased to the valve seat through a control spring;

at least one suction valve connected to said suction passage and at least one discharge valve connected to said discharge passage, said discharge valve being located at the outlet side of said discharge bore, said suction valve and said pressure control valve being located at the inlet side of the suction bore, said pressure control valve being constructed with a through bore through which the suction bore communicates with the suction passage; and a pressure adjusting member supporting said control spring located movably at a cylinder head at the front end of said cylinder, said plunger reciprocating to actuate the suction valve and the discharge valve at the valve device.

2. A reciprocating pump as recited in claim 1, further comprising:

a second pressure receiving face located on said pressure control valve, the second pressure receiving face having a larger pressure receiving area than the first pressure receiving face;

a pressure chamber located at the cylinder head, the second pressure receiving face of said control valve being disposed within said pressure chamber;

a check valve interposed in a liquid delivery conduit communicating with the outlet of said discharge passage; and a bypass conduit located at said liquid delivery conduit at the outlet side of said check valve, the bypass conduit communicating with said pressure chamber.

* * * * *